US005243807A

United States Patent [19]

Randlett

[11] Patent Number: 5,243,807

[45] Date of Patent: Sep. 14, 1993

[54] PACKAGE, IN PARTICULAR FOR PRODUCT SAMPLES, BLANK FOR SAME AND METHOD FOR PACKAGING AND DISPENSING ARTICLES

[75] Inventor: Douglas Randlett, New York, N.Y.

[73] Assignee: Deare Marketing, Inc., New York, N.Y.

[21] Appl. No.: 825,991

[22] Filed: Jan. 27, 1992

[51] Int. Cl.[5] ..... B65B 7/26; B65B 61/18

[52] U.S. Cl. ..... 53/467; 53/133.7; 53/382.1; 53/462

[58] Field of Search ..... 53/467, 462, 464, 461, 53/133.7, 133.3, 207, 381.1, 382.1, 492; 493/87, 963; 206/44.12, 804; 229/208, 87.05, 20, 11

[56] References Cited

U.S. PATENT DOCUMENTS

| | | | |
|---|---|---|---|
| 381,889 | 4/1888 | Scott | 206/804 X |
| 2,195,369 | 3/1940 | Innes | 206/804 X |
| 2,474,166 | 6/1949 | Rumsey, Jr. | 206/804 X |
| 3,367,552 | 2/1968 | Krzyanowski | 206/804 X |
| 4,382,539 | 5/1983 | Kronman | 206/804 X |

*Primary Examiner*—James F. Coan

*Attorney, Agent, or Firm*—Ostrolenk, Faber, Gerb & Soffen

[57] ABSTRACT

A packaging device for an article, blank for a packaging device and method of packaging and dispensing an article. The packaging device is formed from a sheet of material folded into a form so as to define a pocket for the article. The pocket formed has a closed bottom and open top and at least two sides. A flap extends from one of the sides forming the pocket, the flap being folded on itself such that the flap has two opposed faces and a bottom with the article being received between the faces and supported between the faces above the flap bottom. The folded flap is disposed in the pocket such that each face is disposed adjacent a respective side of the pocket, and a pull-tab extends from the flap for enabling a user to pull the flap out of the pocket and simultaneously extract the article received in the flap from the pocket.

43 Claims, 2 Drawing Sheets

PULL TO OBTAIN SAMPLE
DETACH
(POSTAL CARD)
DETACH
D
L
W
X
X
d
d
10
12
14
16
18
20
22
24
26
28
30
32
34
36
40
42
44
46

PACKAGE, IN PARTICULAR FOR PRODUCT SAMPLES, BLANK FOR SAME AND METHOD FOR PACKAGING AND DISPENSING ARTICLES

BACKGROUND OF THE INVENTION

The present invention relates to a device, blank and method for packaging and dispensing an article and, in particular, to a package for enclosing product samples, for example, product samples mailed to customers or potential customers.

U.S. Pat. Nos. 4,942,961, 2,269,039, 2,248,843 and 2,195,369 disclose various product packaging devices.

U.S. Pat. No. 4,942,961 to Focke et al. discloses a cigarette pack including a hard, flip-type box and a foil-type inner blank. The inner blank of the Focke et al. device is formed from a single die-cut piece of tinfoil. The tinfoil blank is folded and glued into a generally-rectangular container. The rectangular container includes a generally U-shaped tongue portion having a top which is grasped by the consumer to allow the raising of cigarettes located in the middle of the package out of the package.

The Focke et al. device has significant disadvantages. Initially, the U-shaped tongue portion is formed in the body portion of the container. Once the tongue section of the Focke et al. device is initially lifted out of the box, the integrity of the container is destroyed. The use of a Focke et al.-like device would be disadvantageous in situations where it is desired to maintain the integrity of the container containing the product being dispensed, for example, samples, where it is desired to keep the container enclosing the sample intact.

Another disadvantage of the Focke et al. device is that the user must first open the package using a separate cover or flap before removing the packaged article, a two-step process.

An additional disadvantage of the device of the Focke et al. patent lies in the fact that perforations must be formed in the tinfoil to enable the U-shaped tongue portion to be removed from the body of the container.

U.S. Pat. No. 2,269,039 to Ross discloses a package for dispensing interfolded paper sheets. Ross uses a hook-pull which is separated from the package through perforations. The hook-pull is folded, so as to cause the first of the interfolded paper sheets to be pulled out of the package when it is removed. In addition to the use of perforations, the device of the Ross patent does not disclose a package which is suitable for the dispensing of many products, for example, product samples. In particular, it is specifically adapted to the dispensing of interfolded paper sheets, for example, paper napkins or handkerchiefs.

U.S. Pat. No. 2,248,843 to Atwood discloses a lifting strip bag, having a separate strip attached at one side of the bag and extending down to the bottom of the bag, and thereafter extending back to the top along the other side. The strip allows the removal of an article contained within the bag. This device is not suitable for the enclosure and mailing of product samples.

U.S. Pat. No. 2,195,369 to Innes discloses a dispensing package, for example, for cigarettes, having a dispensing unit formed from a strip of material and which allows a first portion of the contents contained in the package to be dispensed. Like the other devices, the package of this reference also does not disclose a convenient package for mailing and dispensing product samples, and requires a two-step removal process in order to extract the packaged item or items.

Other U.S. Pat. Nos. of which applicant is aware, relating to packaging designs, include the following: 2,415,117; 2,474,166; 2,644,634; 3,104,011; 1,135,444; 1,585,051; 1,586,248; 1,911,212; 2,047,090; 2,325,145; 2,447,279; 2,700,464; 3,215,337; 3,399,762; 3,589,505; 4,464,552; French patent 1,297,965; and British patent 1,466,264.

None of these references provides a convenient packaging device for product samples.

SUMMARY OF THE INVENTION

It is an object of the present invention to provide a packaging device.

It is a further object of the present invention to provide a packaging device for mailing and dispensing products, for example, product samples.

It is yet still a further object of the present invention to provide a packaging device which is made from a single blank piece of packaging material, for example, paper, plastic or any other suitable material.

It is yet still another object of the present invention to provide a packaging device which maintains the integrity of the package once it is opened by the consumer.

It is yet still a further object of the present invention to provide a packaging device which is simple to manufacture.

It is yet still a further object of the present invention to provide a packaging device which is easily handled by a consumer and which allows convenient and simple dispensing of the product contained therein.

It is yet still another object of the present invention to provide such a packaging device which includes means as part of the device which can be forwarded back to the sender or manufacturer, via the mail system, for example, in order to obtain or provide further information concerning the product dispensed.

It is yet still a further object of the present invention to provide a product dispenser which uses the same means for opening the dispenser as for extracting the product from the dispenser.

It is yet still a further object of the present invention to provide a packaging device which has a tab portion which acts as a closure for the packaging device, and, which, when opened, reveals a pocket in which the product is disposed, while at the same time providing the means for extracting the product from the packaging device.

It is yet still a further object of the present invention to provide such a packaging device which is not destroyed upon opening by the consumer.

It is yet still a further object of the present invention to provide a packaging device which includes a business reply card as a part of the packaging device, so that there is no need to insert any additional brochures or printed matter.

It is yet still another object of the present invention to provide a packaging device for a product which can be forwarded through the mail system.

It is yet still a further object of the present invention to provide a packaging device which can be made inexpensively and minimizes mailing costs, preferably being made of flexible cover stock material rather than corrugated packaging material.

It is yet another object of the present invention to provide a blank for a packaging device as described.

It is yet still a further object of the invention to provide methods for packaging and dispensing articles.

The above and other objects of the present invention are achieved by a packaging device for an article comprising a sheet of material folded into a form so as to define a pocket for the article, the pocket having a closed bottom, open top, and at least two sides, the sides having edge portions, a flap extending from one of the sides forming the pocket and adjacent the open top, the flap being folded on itself such that the flap has two opposed faces and a bottom with the article being received between the faces and supported between the faces above the flap bottom, the folded flap being disposed in the pocket such that each face is disposed adjacent a respective side of the pocket, and a pull-tab extending from the flap for enabling a user to pull the flap out of the pocket and simultaneously extract the article from the pocket.

The pull-tab preferably is folded over the open top of the product, and sealed to a side of the pocket with a suitable fastening means, such as an adhesive, and preferably a releasable adhesive.

The above and other objects of the present invention are furthermore achieved by a packaging device for an article, the packaging device made from a blank of material which is folded into shape as the packaging device, the blank comprising a single sheet of material having a generally T-shape, including a first portion forming a side of the packaging device, and two integrally extending second portions extending in opposed first directions from said first portion on opposite edges of the first portion and forming a second side of the packaging device when said two second portions are folded over each other and fastened to each other, the blank further including a first integral flap extending from the first portion in a second direction substantially perpendicular to the first directions, and forming a bottom for the packaging device when said first flap is folded onto at least one of the second portions, said first and second sides and first flap being folded to form a pocket having an open top for the article, with said pocket being defined by said first and second sides, said first flap forming a bottom for said pocket and two other sides formed at least by a fold line between the first and second sides; the blank further including a second flap integrally extending from an edge of the first side in a direction opposite the second direction, the second flap being foldable on itself such that the second flap has two opposed faces and a bottom with the article being receivable between the faces, the folded second flap being disposed in the pocket such that each face is disposed adjacent a respective side of the pocket; and a pull-tab extending from the second flap for enabling a user to pull the second flap out of the pocket so as to unfold the second flap and simultaneously extract the article receivable in the pocket from the pocket.

The above and the objects are achieved according to another aspect of the invention by a blank for a packaging device for an article, the blank comprising a sheet of material which is folded into shape as the packaging device, the blank comprising a single sheet of material having a generally T-shape, including a first portion forming a side of the packaging device, and two integrally extending second portions extending in opposing first directions from said first portion on opposite edges of the first portion and forming a second side of the packaging device when said two second portions are folded over each other and fastened to each other, the blank further including a first integral flap extending from the first portion in a second direction substantially perpendicular to the first directions, and forming a bottom for the packaging device when said first flap is folded onto at least one of the second portions, said first and second sides and first flap being folded to form a pocket having an open top for the article with said pocket being defined by said first and second sides, said first flap forming a bottom for said pocket and two other sides formed at least by a fold line between the first and second sides; the blank further including a second flap integrally extending from an edge of the first side in a direction opposite the second direction, the second flap being foldable on itself such that the second flap has two opposed faces and a bottom with the article being receivable between the faces, the folded second flap being disposed in the pocket such that each face is disposed adjacent a respective side of the pocket; and a pull-tab extending from the second flap for enabling a user to pull the second flap out of the pocket so as to unfold the second flap and simultaneously extract the article receivable in the pocket from the pocket.

According to another aspect, the above and other objects of the invention are achieved by a method for packaging an article comprising providing a pocket having an open top and formed by folding a blank of material into the pocket, with the pocket having two opposed sides and a bottom, the bottom being formed by at least a fold line, two other sides of the pocket being each formed at least by a fold line between the two opposed sides; providing a flap integrally extending from one of the sides, with the flap extending down into the pocket and returning back out of the open top, the article being receivable in the flap in the pocket; covering the open top of the pocket with a portion of said flap extending out of the pocket; and fastening said portion of said flap back to said one side from where said flap extends in order to close the pocket and hold the article in the pocket.

In a preferred embodiment, the method further comprises opening the pocket and removing the article, the step of opening comprising removing said portion of said flap from said one side revealing the article in the pocket and pulling said portion and thereby said flap out of the pocket, thus simultaneously extracting the article disposed in the flap from the pocket.

According to yet still another aspect, the invention comprises a method for dispensing an article from a package.

Other features and advantages of the present invention will become apparent from the following description of the invention which refers to the accompanying drawings.

BRIEF DESCRIPTION OF THE DRAWINGS

The invention will be described in greater detail in the following detailed description with reference to the drawings in which.

DETAILED DESCRIPTION OF THE INVENTION

Figures 1, 3, 4:
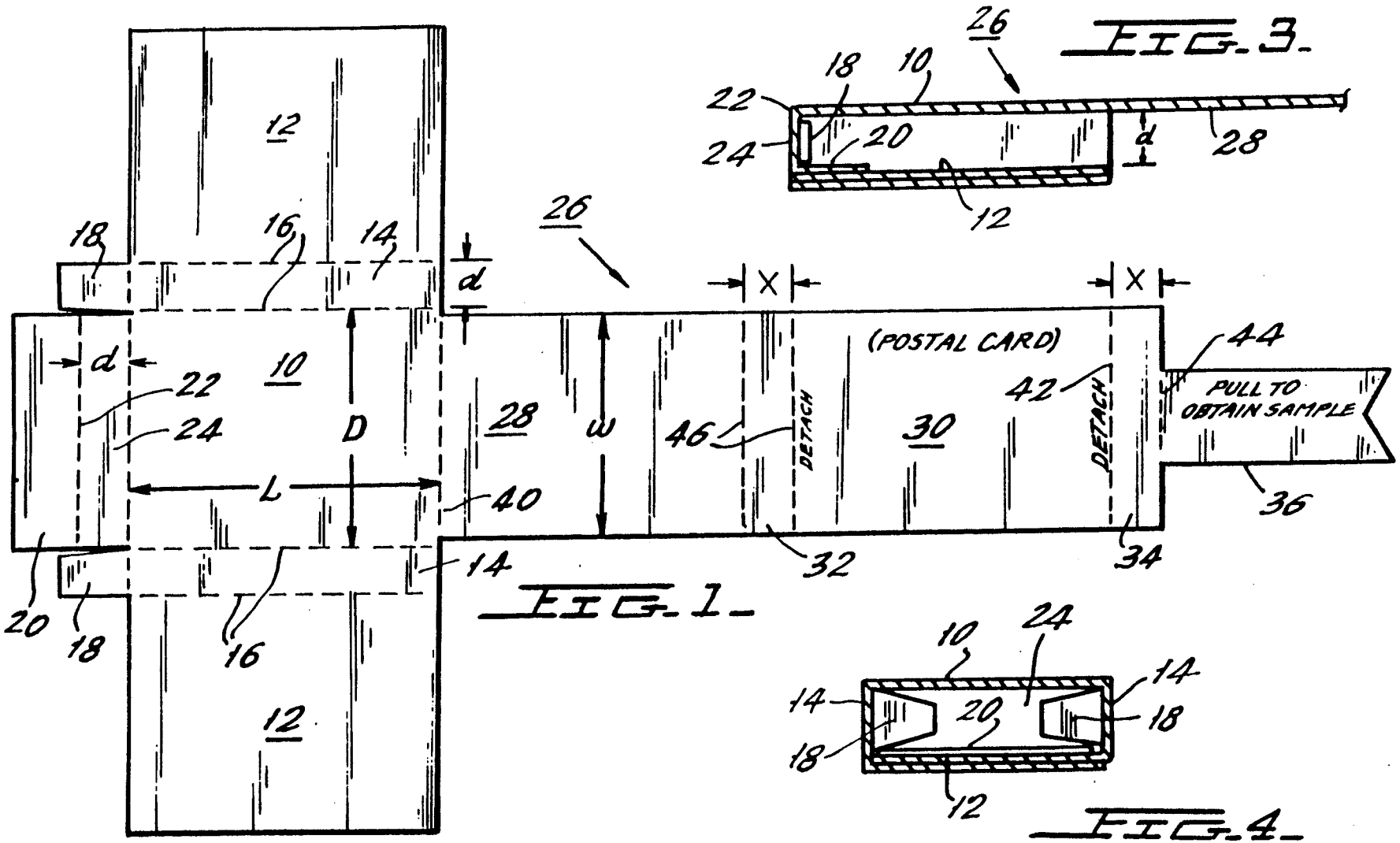
FIG. 1 shows a laid-out view of a blank for the packaging device according to the present invention.
FIG. 3 shows a side cross-sectional view through the packaging device according to the present invention in its opened state, taken along lines 3—3 of FIG. 7, and revealing how the device is folded into its form.
FIG. 4 shows a transverse cross-section through the packaging device according to the present invention, taken along lines 4—4 of FIG. 7, and showing how the packaging device is folded into position.

With reference now to the drawings, FIG. 1 is a laid-out view of the blank of stock material for the packaging device according to the present invention. The stock material may comprise any flexible material, for example, paper, plastic, resilient cardboard, etc. In order to hold down mailing costs, and if the protection is adequate, the material may simply comprise a thin sheet of paper or plastic, although other resilient materials can also be used. Additionally, although a single material is shown in FIG. 1, a composite device can be made from different materials, e.g., the pocket for the article might be a more rigid material, with the flap for extracting the article being made of a more resilient material. This will be clearer from the description below.

The blank of material includes a first portion 10 forming a side of the completed package and two portions 12, the two portions 12 being folded one on top of the other along fold lines 16 to form a second side for the package. FIG. 3 shows the side portion 10, as well as the two portions 12 which are folded on top of each other, in cross-section. Preferably, the two portions 12 are secured to each other by a suitable adhesive, although other fastening means can be used. Depending upon the desired thickness (d) of the packaging device, the two portions 12 can include portions 14, which give the device its desired thickness, as shown in FIG. 4. Suitable fold lines 16 are provided in the blank for allowing the formation of the portions 14. Tabs 18 can be provided extending from the portions 14, which are suitably secured to a portion 20 extending from the side portion 10. Portion 20 preferably includes a fold line 22 for forming a bottom portion 24 of the container. Tab portions 18 are suitably secured to the portion 24, as by adhesive, in the manner shown in FIGS. 3 and 4.

Portions 14 and 24 and tabs 18 can be dispensed with, for example, if an article which is substantially thin is being packaged, in which case only one fold line 16 is provided on each edge of the sides 10,12, the fold line itself providing the side portions for the pocket formed by the surfaces 10,12.

On the other side of the portion 10 away from the tab 20, a lengthy extending flap 26 is disposed. The flap 26 comprises two portions 28 and 30, which each have a length approximately equal to the length L of the portion 10. In one embodiment, however, the length of the portions 28 and 30 may be made somewhat less than the length L in order to facilitate grasping of the packaging device and removal of the product contained therein, as will be explained later, below.

In addition to the portions 28 and 30, two portions 32 and 34 are provided, which provide, respectively, a flap bottom for supporting the product to be dispensed by the packaging device and a closing top for the packaging device. The dimension X of the bottom and top portions preferably is made somewhat less than the thickness d of the portions 14 and 24 of the packaging device. At the very end of the extending flap 26, a tab 36 is provided for closing the packaging device and providing a convenient pull-tab for dispensing the product from the packaging device. On one side of the pull-tab 36, preferably a notation instructing the consumer to pull the tab to obtain the sample is disposed, as shown in FIG. 1. On the other side, the pull-tab may contain a notation such as "open tab" to instruct the consumer to open the package using the pull-tab. This will be more apparent when viewing FIG. 2.

Turning now to FIGS. 2 and 5-7, FIG. 2 shows the packaging device according to the present invention with a product 38 to be dispensed contained therein. As shown, the tab 36 contains the notation to open the tab on its visible side, and the tab 36 is suitably secured to the portion 10 of the packaging device, for example, through a suitable adhesive, and preferably an adhesive which allows convenient, releasable separation of the tab from the portion 10.

Figures 2, 5, 6, 7:
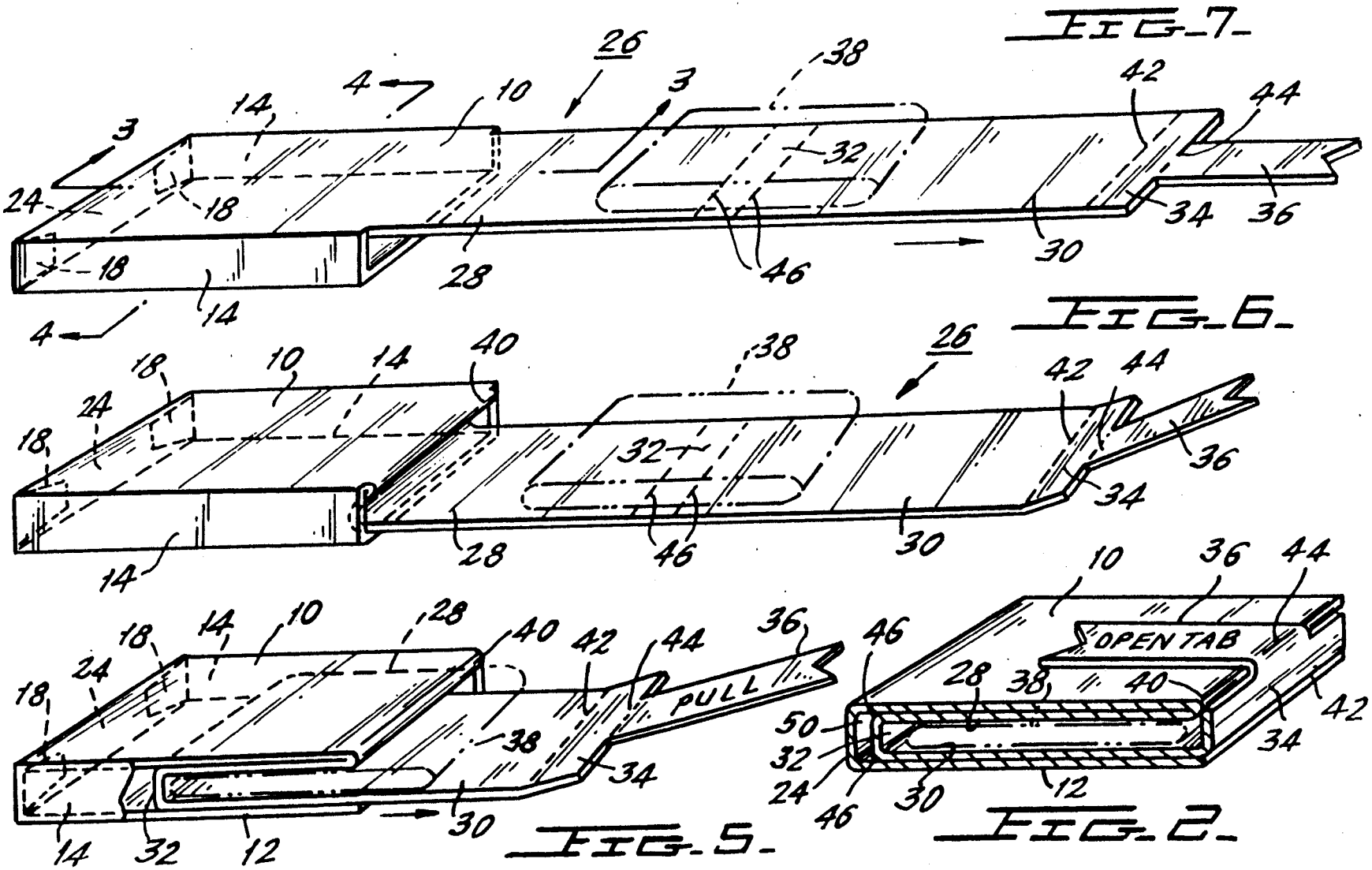
FIG. 2 shows a perspective view of the packaging device according to the present invention containing an article therein with the packaging device closed, for example, for mailing, and prior to opening by the consumer.
FIG. 5 shows a perspective view of the packaging device according to the present invention, partially opened.
FIG. 6 shows the packaging device according to the present invention in an almost completely extended state, showing how the product contained within the packaging device is extracted from the device.
FIG. 7 shows the packaging device according to the present invention in its fully-opened state.

As shown in FIG. 2, the packaging device according to the present invention is folded such that the portions 12 are folded over each other, suitably fastened, and the portion 20 is folded over on fold line 22 such that it is secured to one of the portions 12, as shown in FIG. 3, with the tabs 18 suitably secured to the portion 24, thereby providing a pocket for the item 38. The lengthy extending flap 26 is folded at the fold line 40, back into the pocket of the packaging device, such that the portions 28, 32 and 30 are contained completely within the pocket of the packaging device. The top portion 34 is exposed, and folded along fold line 42 at the exposed top of the packaging device, providing a cover for the pocket, leaving the tab 36 to be folded at fold line 44 and secured to the portion 10 of the packaging device. The bottom 32 of the folded flap in the pocket for holding the product 38 is formed on suitable fold lines 46, as shown most clearly in FIG. 1.

In use, the product 38 is enclosed between the portions 28 and 30 of the flap of the previously-folded packaging device, as shown in FIG. 2, and forwarded to the consumer, for example, by mail. Alternatively, the article to be packaged can be disposed on the unfolded blanks of FIG. 1, and the blank suitably folded around the article, thus enclosing it. This latter method may be particularly suited to automated packaging. Upon receipt, the consumer notes the external notation to open the tab 36 and, upon opening the tab, observes the notation to pull the tab 36 to extract the product sample. The packaging device is held in one hand, with the tab 36 being pulled by the other hand.

One way to hold the packaging device according to the invention in order to remove the product 38 contained therein is to grasp the device in one hand, such that the hand straddles the side portions 14 of the packaging device. By pulling the tab 36, the portions 28 and 30 of the folded lengthy extending flap 26 are pulled out of the packaging device, as shown in FIGS. 5 and 6, removing the product sample at the same time as the lengthy extending flap 26 unfolds from the packaging device. The product is thus dispensed through the step of pulling the tab 36. In effect, the step of opening the package extracts the packaged item.

As shown in FIG. 1, the width W of the lengthy extending flap 26 may be made somewhat smaller than the width D of the packaging device itself, in order to facilitate unfolding of the lengthy extending flap 26 out of the packaging device. By making the width W slightly less than the width D, the edges of the lengthy extending flap 26 will not unduly rub against the portions 14 during removal of the product 38, facilitating removal.

As discussed previously, the length of the portions 28 and 30 preferably is made less than the length L of the portion 10. The reason for this is so that a small space 46 can be maintained at the bottom of the packaging device. This allows the consumer, alternatively, to grasp the device by pinching between the fingers at the bottom, between the point X (FIG. 2) approximately in the middle of the portion 10 at the bottom of the device, and the corresponding point on the portion 12 on the opposite side of the packaging device. A suitable notation can be disposed at the location X on one or both portions 10 and 12 of the packaging device, informing the consumer to hold the packaging device between the fingers at these locations while pulling the tab 36. This method of holding the packaging device to extract the product prevents pressure from being exerted along the edges of the portions 28 and 30 of the extending flap 26 during unfolding of the extending flap 26 and removal of the product 38.

As discussed previously, although a blank of a single material is shown in FIG. 1, alternatively, a composite construction could be used. For example, so long as flap 26 is made flexible, the remainder of the device can be made relatively rigid. The flap 26 could be made of a thin, flexible material, e.g., plastic, paper or card stock, with the other portions being made of a more rigid, but foldable, material, such as cardboard or rigid card stock or plastic.

As discussed previously, another feature of the packaging device according to the present invention is that the portion 30, or, additionally, the portion 28, can be utilized as a postal or business reply card to allow the consumer to obtain further information from the sender or manufacturer or comment on the product, for example. The consumer can be informed to detach the postal card 30 from the packaging device at the fold lines 46 and 48, for example. These fold lines can also be provided with suitable perforations to allow detachment.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A packaging device for an article, comprising:

a sheet of material folded into a form so as to define a pocket for the article, the pocket having a closed bottom, open top and at least two sides, the sides having edge portions;

a flap extending from one of the sides forming the pocket and adjacent the open top, the flap being folded on itself such that the flap has two opposed faces and a bottom with the article being receivable between the faces and supported between the faces above the flap bottom, the folded flap being disposed in the pocket such that each face is disposed adjacent a respective side of the pocket with the article between the faces; and a pull-tab extending from the flap for enabling a user to pull the flap out of the pocket and simultaneously extract the article receivable between the faces in the pocket from the pocket.

2. The packaging device of claim 1, wherein said sheet of material comprises a single sheet of material with said flap integrally extending from a portion of the sheet forming one of the sides of the pocket.

3. The packaging device of claim 1, wherein said pocket side edge portions, pocket closed bottom and flap bottom have one dimension which is the thickness of a fold line.

4. The packaging device of claim 1, wherein said pocket side edge portions and pocket bottom are each substantially larger than a fold line, giving said pocket a substantially box-shape.

5. The packaging device of claim 4, wherein said flap bottom is substantially larger than a fold line.

6. The packaging device of claim 1, wherein said pull-tab comprises means for closing said packaging device, said pull-tab being folded onto one side of said pocket and fastened thereto, whereby the user can undo said fastening to enable grasping of the pull-tab to extract the article from the pocket as the pull tab is pulled.

7. The packaging device of claim 6, wherein said pull-tab includes a portion forming a top for said open top of said product.

8. The packaging device of claim 1, wherein the sides have a length and said faces have a length substantially the same as the length of the sides.

9. The packaging device of claim 1, wherein said faces have a length less than the length of the sides.

10. The packaging device of claim 9, wherein a space is provided between the bottom of the flap and the bottom of the pocket to enable the two sides of the pocket adjacent the space to be grasped between a user's fingers to facilitate removal of the article.

11. The packaging device of claim 1, wherein said faces have a width less than the width of the sides to facilitate removal of the folded flap from the pocket by minimizing rubbing of edges of the faces with said side portions of the pocket.

12. The packaging device of claim 1, wherein a portion of the device comprises a postal reply card.

13. The packaging device of claim 12, wherein the portion comprising the postal reply card comprises one of said faces.

14. The packaging device of claim 1, further comprising notations on said device, instructing the user how to open the device, hold the device, and remove the article therefrom.

15. The packaging device of claim 1, wherein the flap is formed from a flexible material which is different from the material of the pocket.

16. A packaging device for an article, the packaging device made from a blank of material which is folded into shape as the packaging device, the blank comprising:

a single sheet of material having a generally T-shape, including a first portion forming a side of the packaging device, and two integrally extending second portions extending in opposed first directions from said first portion on opposite edges of the first portion and forming a second side of the packaging device when said two second portions are folded over each other and fastened to each other, the blank further including a first integral flap extending from the first portion in a second direction substantially perpendicular to the first directions, and forming a bottom for the packaging device when said first flap is folded onto at least one of the second portions, said first and second sides and first flap being folded to form a pocket having an open top for the article with said pocket being defined by said first and second sides, said first flap forming a bottom for said pocket and two other asides formed at least by a fold line between the first and second sides;

the blank further including a second flap integrally extending from an edge of the first side in a direction opposite the second direction, the second flap being foldable on itself such that the second flap has two opposed faces and a bottom with the article being receivable between the faces, the folded second flap being disposed in the pocket such that each face is disposed adjacent a respective side of the pocket with the article between the faces; and a pull-tab extending from the second flap for enabling a user to pull the second flap out of the pocket so as to unfold the second flap and simultaneously extract the article receivable between the faces in the pocket from the pocket.

17. The packaging device of claim 16, wherein said second portions have additional portions thereof forming said two other sides for the pocket, said first flap having a portion forming the bottom of the pocket, said two other sides each having an extent in the first direction of the blank larger than the width of a fold line, said pocket bottom having a like extent in said second direction, giving said pocket when said blank is folded and assembled a substantially box-shape.

18. The packaging device of claim 17, wherein said second flap bottom is substantially larger than a fold line.

19. The packaging device of claim 16, wherein said pull-tab comprises means for closing said open top of said pocket of said packaging device, said pull-tab being folded onto one side of said pocket and fastened thereto, whereby the user can undo said fastening to enable grasping of the pull-tab to extract the article from the pocket as the pull tab is pulled.

20. The packaging device of claim 16, wherein said second flap bottom has a dimension which is the thickness of a fold line.

21. The packaging device of claim 16, wherein the sides have a length and said faces have a length substantially the same as the length of the sides.

22. The packaging device of claim 16, wherein the sides have a length and said faces have a length less than the length of the sides.

23. The packaging device of claim 22, wherein a space is provided between the bottom of the second flap and the bottom of the pocket to enable the two sides of the pocket to be grasped between a user's fingers to facilitate removal of the article.

24. The packaging device of claim 16, wherein said faces have a width less than the width of the sides to facilitate removal of the folded second flap from the pocket by minimizing rubbing of edges of the faces with said other sides of the pocket.

25. The packaging device of claim 16, wherein a portion of the device comprises a postal reply card.

26. The packaging device of claim 25, wherein the portion comprising the postal reply card comprises one of said faces.

27. The packaging device of claim 16, further comprising notations on said device, instructing the user how to open the device, hold the device, and remove the article therefrom.

28. A blank for packaging device for an article, the blank comprising a sheet of material which is folded into shape as the packaging device, the blank comprising:

a single sheet of material having a generally T-shape, including a first portion forming a side of the packaging device, and two integrally extending second portions extending in opposed first directions from said first portion on opposite edges of the first portion and forming a second side of the packaging device when said two second portions are folded over each other and fastened to each other, the blank further including a first integral flap extending from the first portion in a second direction substantially perpendicular to the first directions, and forming a bottom for the packaging device when said first flap is folded onto at least one of the second portions, said first and second sides and first flap being folded to form a pocket having an open top for the article with said pocket being defined by said first and second sides, said first flap forming a bottom for said pocket and two other sides formed at least by a fold line between the first and second sides;

the blank further including a second flap integrally extending from an edge of the first side in a direction opposite the second direction, the second flap being foldable on itself such that the second flap has two opposed faces and a bottom with the article being receivable between the faces, the folded flap being disposed in the pocket such that each face is disposed adjacent a respective side of the pocket with the article between the faces; and a pull-tab extending from the second flap for enabling a user to pull the second flap out of the pocket so as to unfold the second flap and simultaneously extract the article receivable between the faces in the pocket from the pocket.

29. The blank of claim 28, wherein said second portions of said blank have additional portions thereof forming said two other sides for the pocket, said first flap having a portion forming the bottom of the pocket, said two other sides each having an extent in the first direction of the blank larger than the width of a fold line, said pocket bottom having a like extent in said second direction, giving said pocket when said blank is folded and assembled a substantially box-shape.

30. The blank of claim 29, wherein said second flap bottom is substantially larger than a fold line.

31. The blank of claim 28, wherein said pull-tab comprises means for closing said packaging device, said pull-tab being folded onto one side of said pocket and fastened thereto, whereby the user can undo said fastening to enable grasping of the pull-tab to extract the article from the pocket as the pull-tab is pulled.

32. The blank of claim 28, wherein said second flap bottom has a dimension which is the thickness of a fold line.

33. The blank of claim 28, wherein the sides have a length and said faces have a length substantially the same as the length of the sides.

34. The blank of claim 28, wherein the sides have a length and said faces have a length less than the length of the sides.

35. The blank of claim 34, wherein a space is provided between the bottom of the second flap and the bottom of the pocket to enable the two sides of the pocket to be grasped between a user's fingers to facilitate removal of the article.

36. The blank of claim 28, wherein said faces have a width less than the width of the sides to facilitate removal of the folded second flap from the pocket by minimizing rubbing of edges of the faces with said other sides of the pocket.

37. The blank of claim 28, wherein a portion of the device comprises a postal reply card.

38. The blank of claim 37, wherein the portion comprising the postal reply card comprises one of said faces.

39. The blank of claim 28, further comprising notations on said blank, instructing the user of the packaging device how to open the device, hold the device, and remove the article therefrom.

40. A method for packaging an article comprising:

providing a pocket having an open top and formed by folding a blank of material into the pocket, with the pocket having two opposed sides and a bottom, the bottom being formed by at least a fold line, two other sides of the pocket being each formed at least by a fold line between the two opposed sides;

providing a flap integrally extending from one of the sides, with the flap being folded and extending down into the pocket and returning back out of the open top, the article being receivable in the flap in the pocket between two faces formed from adjacent portions of the folded flap;

covering the open top of the pocket with a portion of said flap extending out of the pocket; and fastening said portion of said flap back to said one side from where said flap extends in order to close the pocket and hold the article in the pocket.

41. The method of claim 40, further comprising opening the pocket and removing the article, the step of opening comprising removing said portion of said flap from said one side revealing the article in the pocket and pulling said portion and thereby said flap out of the pocket, thus simultaneously extracting the article disposed in the flap from the pocket.

42. Apparatus for packaging an article comprising:

a pocket having an open top and formed by folding a blank of material into the pocket, with the pocket having two opposed sides and a bottom, the bottom being formed by at least a fold line, two other sides of the pocket being each formed at least by a fold line between the two opposed sides;

a flap integrally extending from one of the sides, with the flap being folded and extending down into the pocket and returning back out of the open top, the article being receivable in the flap in the pocket between two faces formed from adjacent portions of the folded flap;

a portion of the flap extending out of the pocket and covering the open top of the pocket; and means for fastening said portion of said flap back to said one side from where said flap extends in order to close the pocket and hold the article in the pocket, said portion of said flap further comprising means for opening the pocket and removing the article, whereby when said portion of said flap is removed from said one side, said article in the pocket is revealed and by pulling said portion out of the pocket, said article is simultaneously extracted from between the faces of the flap in the pocket.

43. A method for dispensing an article from a package, wherein the package has a pocket having an open top and formed by folding a blank of material into the pocket, with the pocket having two opposed sides and a bottom, the bottom being formed by at least a fold line, two other sides of the pocket being each formed at least by a fold line between the two opposed sides;

a flap integrally extending from one of the sides, with the flap being folded and extending down into the pocket and returning back out of the open top, the article being receivable in the flap in the pocket between two faces formed from adjacent portions of the folded flap;

a portion of the flap extending out of the pocket and covering the open top of the pocket; and means for fastening said portion of said flap back to said one side from where said flap extends in order to close the pocket and seal the article in the pocket;

the method comprising removing said portion of said flap from said one side revealing the article in the pocket and pulling said portion and thereby said flap out of the pocket, thus simultaneously extracting the article disposed between the faces of the flap from the pocket.

* * * * *